US008910831B2

(12) United States Patent
Williams

(10) Patent No.: US 8,910,831 B2
(45) Date of Patent: Dec. 16, 2014

(54) SYSTEM FOR DISPENSING SPRAYABLE MATERIAL

(71) Applicant: Aervoe Industries Incorporated, Gardnerville, NV (US)

(72) Inventor: Mark Williams, Genoa, NV (US)

(73) Assignee: Aervoe Industries, Inc., Gardnerville, NV (US)

( * ) Notice: Subject to any disclaimer, the term of this patent is extended or adjusted under 35 U.S.C. 154(b) by 0 days.

(21) Appl. No.: 14/011,096

(22) Filed: Aug. 27, 2013

(65) Prior Publication Data

US 2013/0341352 A1 Dec. 26, 2013

Related U.S. Application Data

(63) Continuation-in-part of application No. 12/831,263, filed on Jul. 7, 2010, now Pat. No. 8,544,686.

(60) Provisional application No. 61/270,568, filed on Jul. 10, 2009.

(51) Int. Cl.

| | |
|---|---|
| ***B65D 35/28*** | (2006.01) |
| ***B05C 17/01*** | (2006.01) |
| ***B65D 75/58*** | (2006.01) |
| ***B05B 11/04*** | (2006.01) |
| ***B05B 11/02*** | (2006.01) |
| ***B05C 17/015*** | (2006.01) |
| ***B05C 17/005*** | (2006.01) |

(52) U.S. Cl.

CPC ..... *B05B 11/048* (2013.01); *B05C 17/0136* (2013.01); *B65D 75/5883* (2013.01); *B05C 17/0123* (2013.01); *B05B 11/02* (2013.01); *B05C 17/015* (2013.01); *B05C 17/00583* (2013.01); *B05C 17/0146* (2013.01)

USPC ..... 222/95; 222/1; 222/105; 222/325; 222/326; 222/386; 222/391; 222/402.1; 222/402.15

(58) Field of Classification Search

CPC .... B65D 83/0055; B65D 83/62; B65D 83/38; B05C 17/00583; B05C 17/0136; B05C 17/0146; B05C 17/015; B05B 11/3056; B05B 11/0043

USPC ..... 222/1, 95, 105, 162, 183, 325–326, 222/386, 391, 394, 402.1, 402.15

See application file for complete search history.

(56) References Cited

U.S. PATENT DOCUMENTS

| | | | |
|---|---|---|---|
| 3,443,725 | A | 5/1969 | Lawhorn |
| 3,799,407 | A | 3/1974 | Loethen |
| 4,193,513 | A | 3/1980 | Bull, Jr. |
| 4,299,336 | A | 11/1981 | Studer |
| 4,516,696 | A | 5/1985 | Elknor |
| 4,685,595 | A | 8/1987 | Segatz |
| 4,998,645 | A | 3/1991 | Pearson |

(Continued)

*Primary Examiner* — Frederick C Nicolas

(57) ABSTRACT

A system for dispensing sprayable material such as paint and other liquefied products. The system includes a dispenser designed to accept a flexible, crushable container filled with sprayable material and having a valve and spray tip at one end. The container is placed into an interior portion in the dispenser with the valve on the container secured in the housing of the dispenser. In operation, a pump action lever is activated causing a piston to slide lengthwise in the housing of the dispenser and exert force on the bottom of the container crushing it as it is emptied and forcing the sprayable material out through the valve and spray tip.

22 Claims, 14 Drawing Sheets

(56) References Cited

U.S. PATENT DOCUMENTS

| | | | |
|---|---|---|---|
| 5,153,820 | A | 10/1992 | MacFarlane et al. |
| 5,323,931 | A | 6/1994 | Robards, Jr. et al. |
| 5,443,181 | A | 8/1995 | Popp |
| 5,482,189 | A | 1/1996 | Dentler |
| 5,560,518 | A | 10/1996 | Catterall et al. |
| 6,123,235 | A | 9/2000 | Hsu |
| 6,966,461 | B2 | 11/2005 | Warner et al. |
| 9,314,149 | | 1/2008 | White |
| 8,544,686 | B2 * | 10/2013 | Williams ..... 222/95 |

* cited by examiner

SYSTEM FOR DISPENSING SPRAYABLE MATERIAL

RELATED U.S. APPLICATION DATA

This is a continuation-in-part of U.S. application Ser. No. 12/831,263 filed Jul. 7, 2010 entitled "System for Dispensing Sprayable Material," which claims priority benefit from provisional application No. 61/270,568 filed on Jul. 10, 2009 entitled "System for Dispensing Sprayable Material."

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

Aerosol cans for depositing paint and other sprayable materials have been in use for some time. The term "aerosol" as used herein refers to a suspension of liquid or solid particles in a gas. Most aerosol cans are made of tin-plated steel or aluminum. Once an aerosol can has been used and emptied in any of its many possible applications such as for food, beverage, paint and aerosol products, it is in demand for recycling. There are over three billion aerosol cans manufactured in the U.S. annually. Many of the products contained in these cans, such as paint products, light lubricants, starting fluids, polishes and waxes, and cleaners, contain substantial amounts of volatile organic compounds (VOCs) as solvents and include flammable propellants. As a result, partially empty aerosol cans are treated as a hazardous waste at collection centers, military bases, industries utilizing large quantities of aerosols, and treatment, storage, and disposal facilities. Typically, an aerosol package consists of a pressurized liquid product packaged inside a hermetically sealed can that is dispensed through a push button spray tip/valve combination. The pressure is created in the aerosol can via a propellant that atomizes the chemical contents and creates the force to easily dispense the product through the valve/tip in a cost effective manner. The spray delivery which is efficient and effective is commonly used across a wide array of products. The hermetic seal saves the product from contamination during storage.

Some specialized products use a bag or container inside a pressurized can. The liquid product is stored inside the bag and the propellant is inside the space in the can surrounding the bag. The propellant creates pressure on the bag to force the product through the spray tip/valve system for use. This type of aerosol packaging can be expensive and redundant and is typically used in creams and lotions. Given the public's concern about solid waste disposal, the aerosol industry teamed with the steel industry to promote the collection of empty aerosol cans in recycling programs nationwide. Thousands of communities now include aerosol product recycling in both household residential and curbside buy-back and drop-off programs. However, solid waste management firms are questioning the potential safety hazards of processing even 'empty' aerosols. This safety question is primarily due to the highly flammable propellants still contained in many cans even when the liquid contents are discharged.

There have been extensive efforts to find alternative solutions to aerosol cans, many of which have proven unsatisfactory. The use of aerosol bags without the can is an option that has not been previously addressed in the prior art. The rigid exterior of a can has been considered essential because of safety concerns for a user in the event that an aerosol bag bursts, causing injury from the propellant materials contained inside the can, or the possibility of fire fueled by these materials. An enormous amount of resources are expended to manufacture cans, collect empty cans, and recycle the empty cans. As a result, it would be highly beneficial to find a solution for deploying aerosol bags but without the can and the propellant. Such a solution would eliminate flammability concerns during dispensing, while still providing the performance results of a spray can application.

The present invention is a system that utilizes a flexible, crushable container similar to the type of container used in some aerosol products, although in this case without a surrounding can and propellant. A dispenser having an elongated housing is provided for receiving the bag. The dispenser is a gun type device that uses a plunger to apply force to the bottom of the bag while the top of the bag with the valve and spray tip is held securely in a slot or valve seat in the other end of the housing. The force exerted by the plunger within the housing creates the hydrostatic pressure inside the bag needed to spray the product through the valve and spray tip. A first trigger and handle on the device are squeezed together to exert force on the plunger. This, in turn, compresses a container spring creating the hydrostatic pressure inside the bag. The user then pulls a second trigger, which activates the valve and dispenses the product. As the product is dispensed, the bag collapses and the container spring extends to its free length. At this point there is little or no pressure on the bag. In a mechanical version of the system, the user renews the cycle by squeezing the first trigger and handle to move the plunger while compressing the container spring and re-creating the hydrostatic pressure needed to dispense remaining product from the bag. The user again pulls the second trigger to dispense the product. This cycle is repeated until the bag is emptied.

BRIEF DESCRIPTION OF THE DRAWINGS

For a better understanding of the present invention, and to show more clearly how it functions, reference will now be made, by way of example, to the accompanying drawings. The drawings show preferred embodiments of the present invention in which.

DETAILED DESCRIPTION

Figure 1:
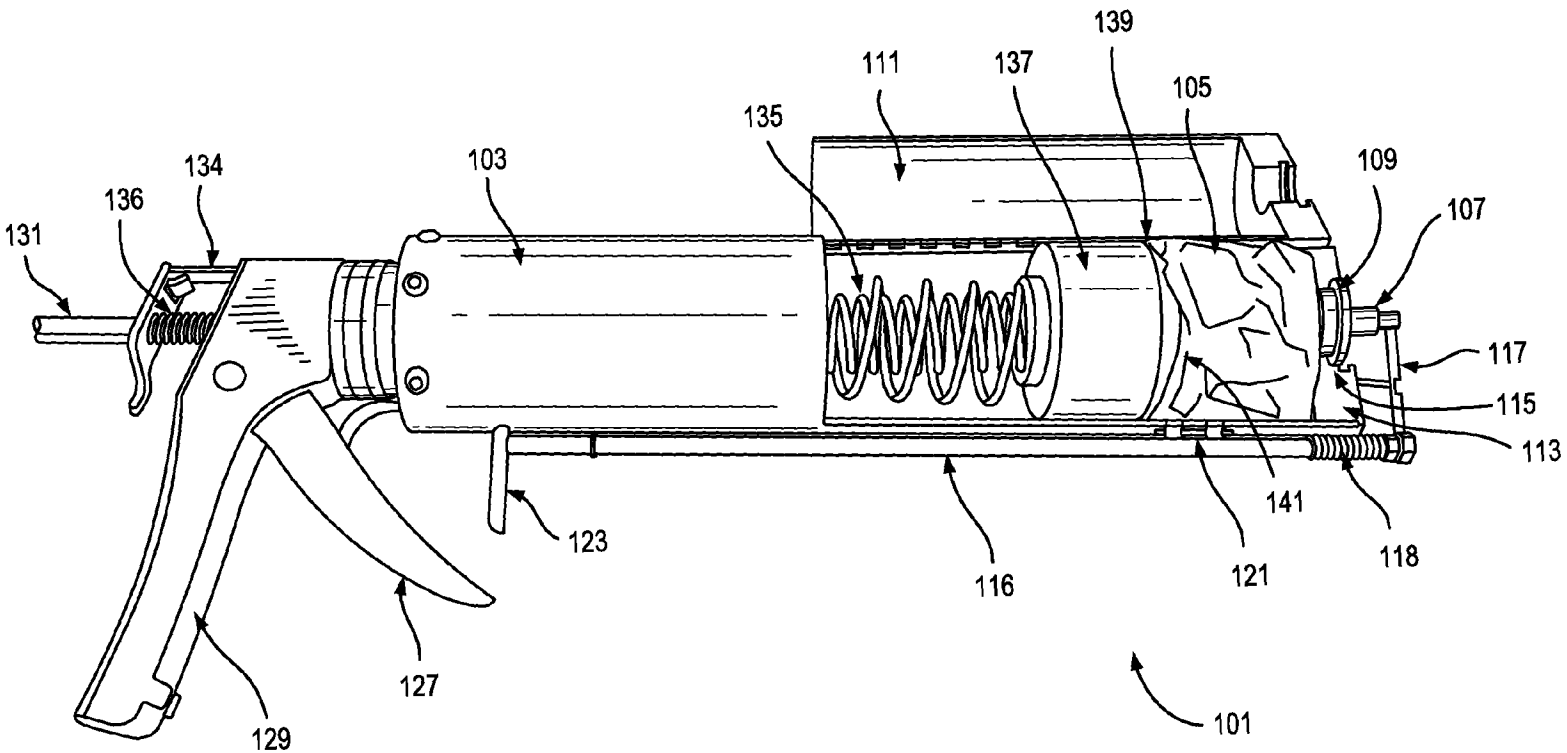
FIG. 1 is a side exterior view of a first embodiment of the dispenser of the system of the present invention.

The present invention will now be described more fully with reference to the accompanying drawings. It should be understood that the invention may be embodied in many different forms and should not be construed as limited to the embodiments set forth herein. Throughout FIGS. 1-16, like elements of the invention are referred to by the same reference numerals for consistency purposes.

Figure 2:
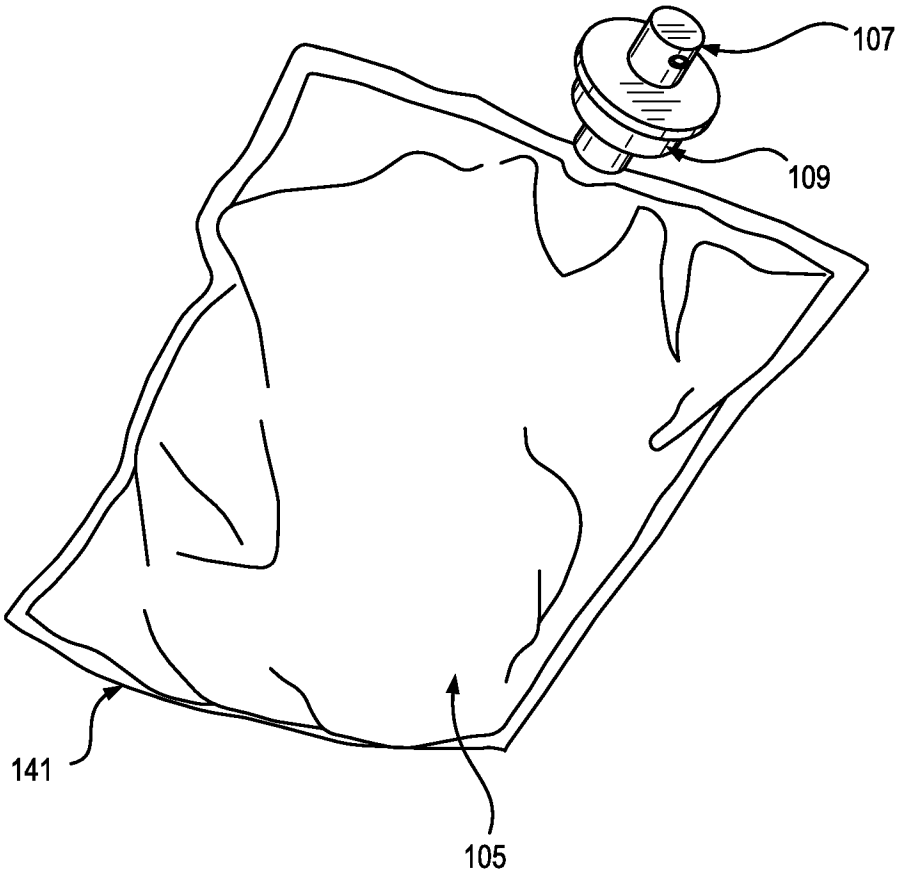
FIG. 2 is a side exterior view of a first embodiment of a crushable container with a valve and spray tip.
Figure 3:
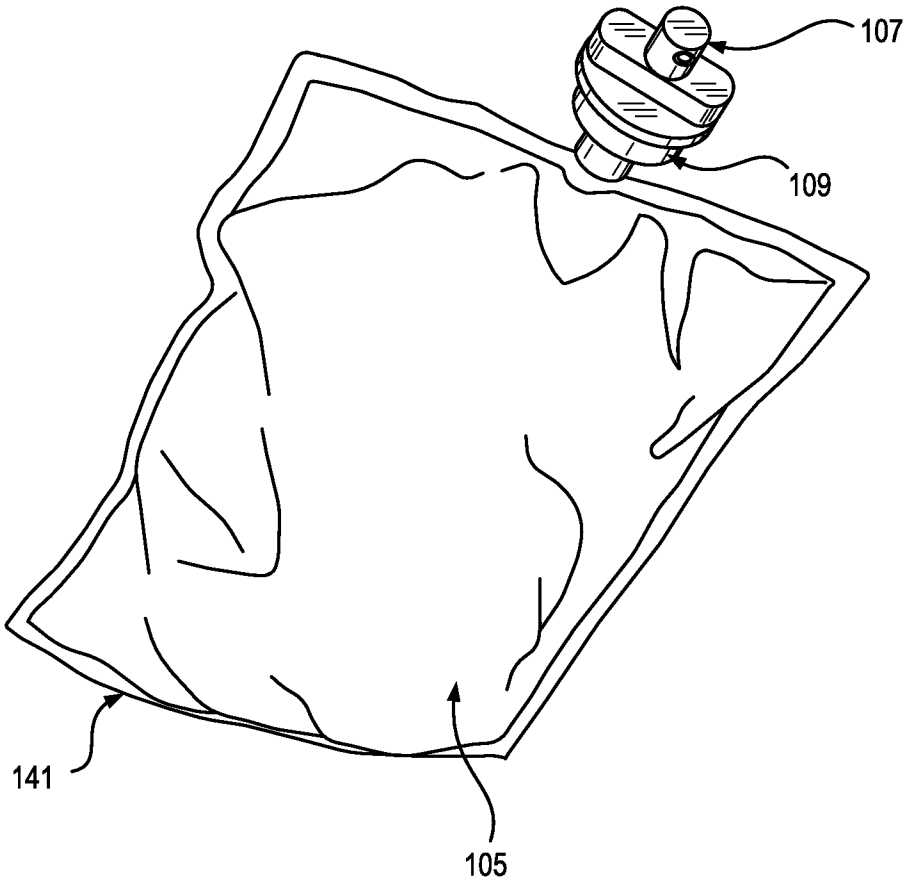
FIG. 3 is a side exterior view of a second embodiment of a crushable container with a valve and spray tip.
Figure 4:
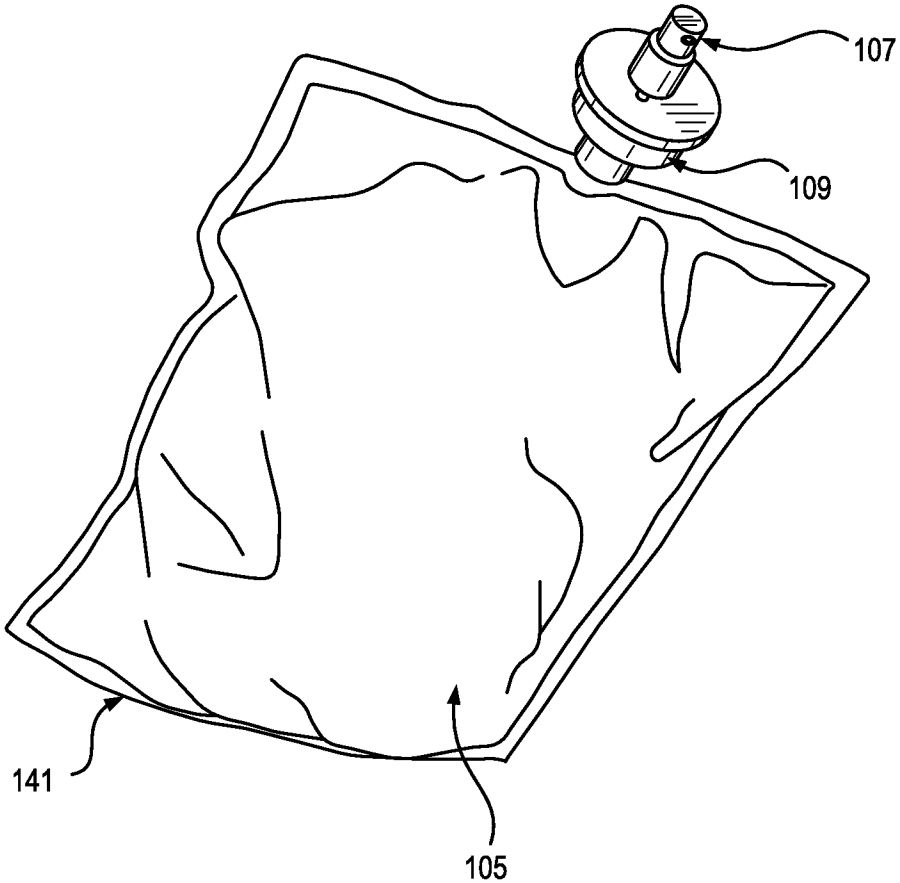
FIG. 4 is a side exterior view of a third embodiment of a crushable container with a valve and spray tip.

FIGS. 1-11 show various views of a dispenser system 101 with a dispenser in the general shape of a gun. Elongated cylinder shaped housing 103 is configured to receive a flexible bag or flexible container 105. Container 105 is shown in FIGS. 2-4 with three different valve and tip embodiments, although there are other embodiments that would work with dispenser system 101 as well.

Container 105 is sealed, and is filled with a sprayable liquid material such as paint. At one end of container 105 is a cap area that has a spray tip 107 situated at the end of a valve 109. Valve 109 is attached to container 105. Spray tip 107 can be of different types. FIG. 2 shows spray tip 107 with a side spray configuration. This type of spray tip is activated by pushing down and to the side and is also referred to as a triangle tilt configuration. FIGS. 3 and 4 show other spray tip types that are both activated by depressing the tip downward in a direction towards the body of bag 105.

Referring to FIGS. 1 and 5-11, container 105 is placed in housing 103 with valve 109 seated in valve seat 113 that is set in the forward end of housing 103. In FIG. 1, spray tip 107 is the depress-activated type like that shown in FIG. 4. A hinged panel 111 matching the shape of housing 103 opens to allow housing 103 to receive container 105 and closes once container 105 has been placed inside. Valve seat 113 is shaped to keep valve 109 in an immobilized state during operation of dispenser 101 with fingers 115 extending on either side of valve 109.

Alternative embodiments for activating spray tip 107 are contemplated and will be apparent to one skilled in the art. In the embodiments shown in FIGS. 5-11, trigger rod 117 makes contact with the forward surface of valve seat 113 and is attached to trigger plate 119. Trigger plate 119 is a substantially triangular flat component that provides a mounting point at each of its three corners. While trigger rod 117 is attached to one mounting point, the second mounting point is attached to trigger bracket 121. The third mounting point of trigger plate 119 is attached to spray trigger 123. Trigger pin 125 secures trigger rod 117 such that, when a user pulls spray trigger 123, trigger rod 117 pulls back spray tip 107 thereby allowing the pressurized contents of container 105 to spray through valve 109 and spray tip 107, and deliver the contents of container 105 as needed.

In an alternative embodiment for activating spray tip 107 shown in FIG. 1, spray trigger 123 can be mounted along the bottom of dispenser housing 103. Instead of using trigger plate 119 and trigger bracket 121, a design using a trigger extender 116, trigger rod 117 and trigger rod spring 118 could be used. Trigger rod 117 is mounted to the end of trigger extender 116. A trigger bracket 121 secures trigger extender 116 to housing 103. By pulling back on spray trigger 123, trigger extender 116 moves with trigger 123 to pull back on trigger rod 117. This action pushes down on spray tip 107 releasing the materials from container 105.

A combination of a plunger trigger 127 and a handle 129 is used to apply a load to the bottom of container 105. Plunger trigger 127 and handle are in a hinged configuration that is squeezed together to cause a pumping action that applies pressure to container 105. The pumping action drives a plunger 131 that has progressive ratchet notches 133 along its length. A plunger bracket 134 is affixed to the housing for keeping plunger 131 in place and a plunger spring biases the plunger in position relative to housing bracket 134. Pressure on container 105 can be re-applied as plunger 131 moves along its length and is re-engaged in the progressive notches as needed when pressure inside container 105 drops below an acceptable level. By repeatedly squeezing plunger trigger 127, a piston spring 135 that sits between housing 103 and plunger bracket 134 is compressed and pressed forward against a piston (or force platen) 137. Piston 137 is substantially flat on both sides and being of large enough width and mass to apply pressure on container 105 while maintaining its shape. The front surface 139 of piston 137 presses against a bottom surface 141 of container 105 with piston 137 being held in place by a surrounding interior surface 143 of housing 103. It is contemplated that during use of dispenser 101, a user alternates between pulling spray trigger 123 to dispense the contents of container 105 as needed, and pumping plunger trigger 127 to restore pressure to container 105.

Figure 6:
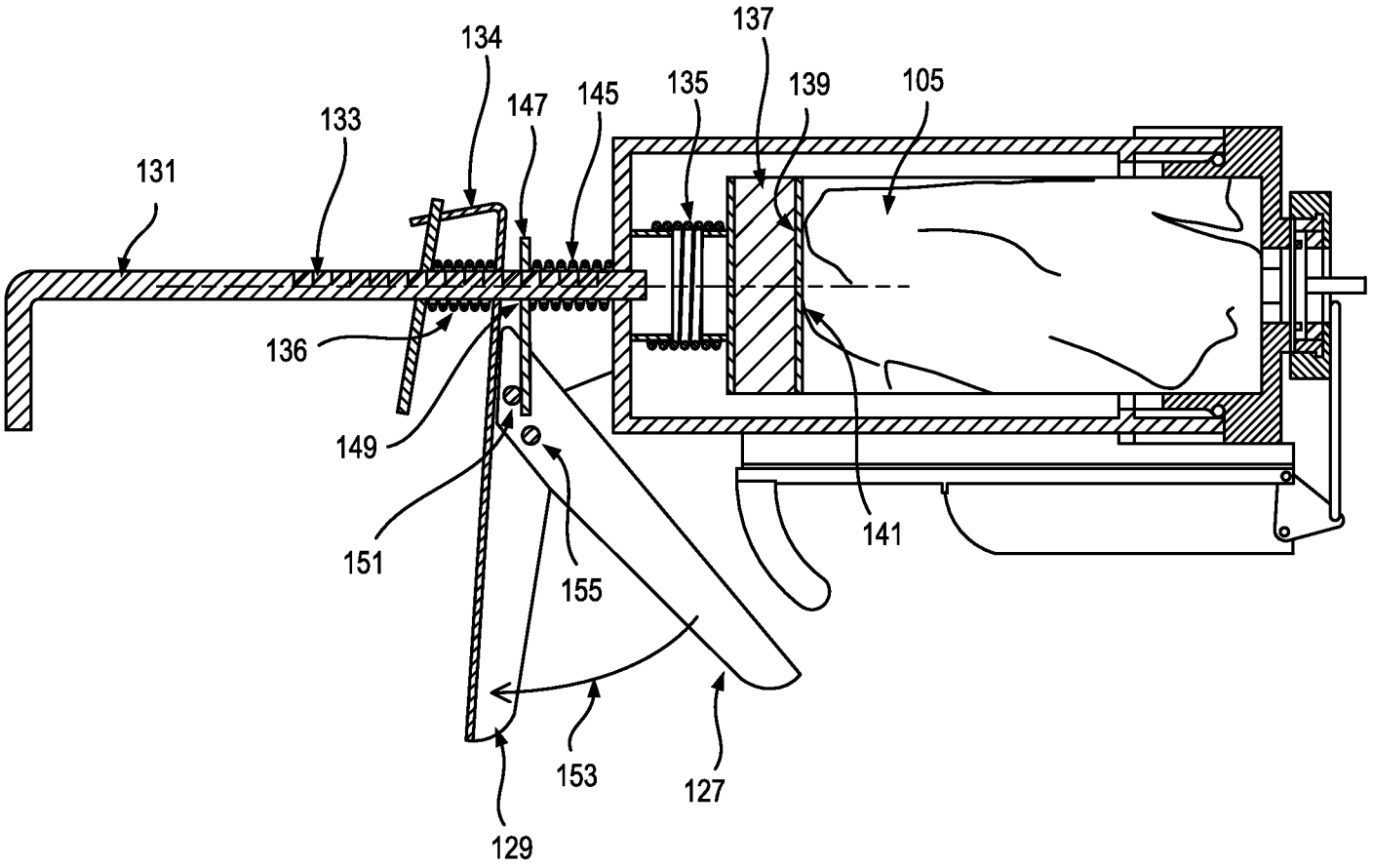
FIG. 6 is an exploded cross-sectional view of the plunger and associated components of the present invention wherein the plunger trigger is shown in an open position in the second embodiment.

A configuration for ratcheting plunger 131 is shown in FIG. 6. A biasing spring 145 and a jam plate 147 having a hole 149 for receiving the plunger 131 are shown. Jam plate 147 is disposed about plunger 131 and rests against an inside surface of handle 127 and a driving pin 151 attached to plunger trigger 127. Biasing spring 145 urges jam plate 47 away from housing 103 so that it is pressed against driving pin 151 and plunger trigger 127

Figure 7:
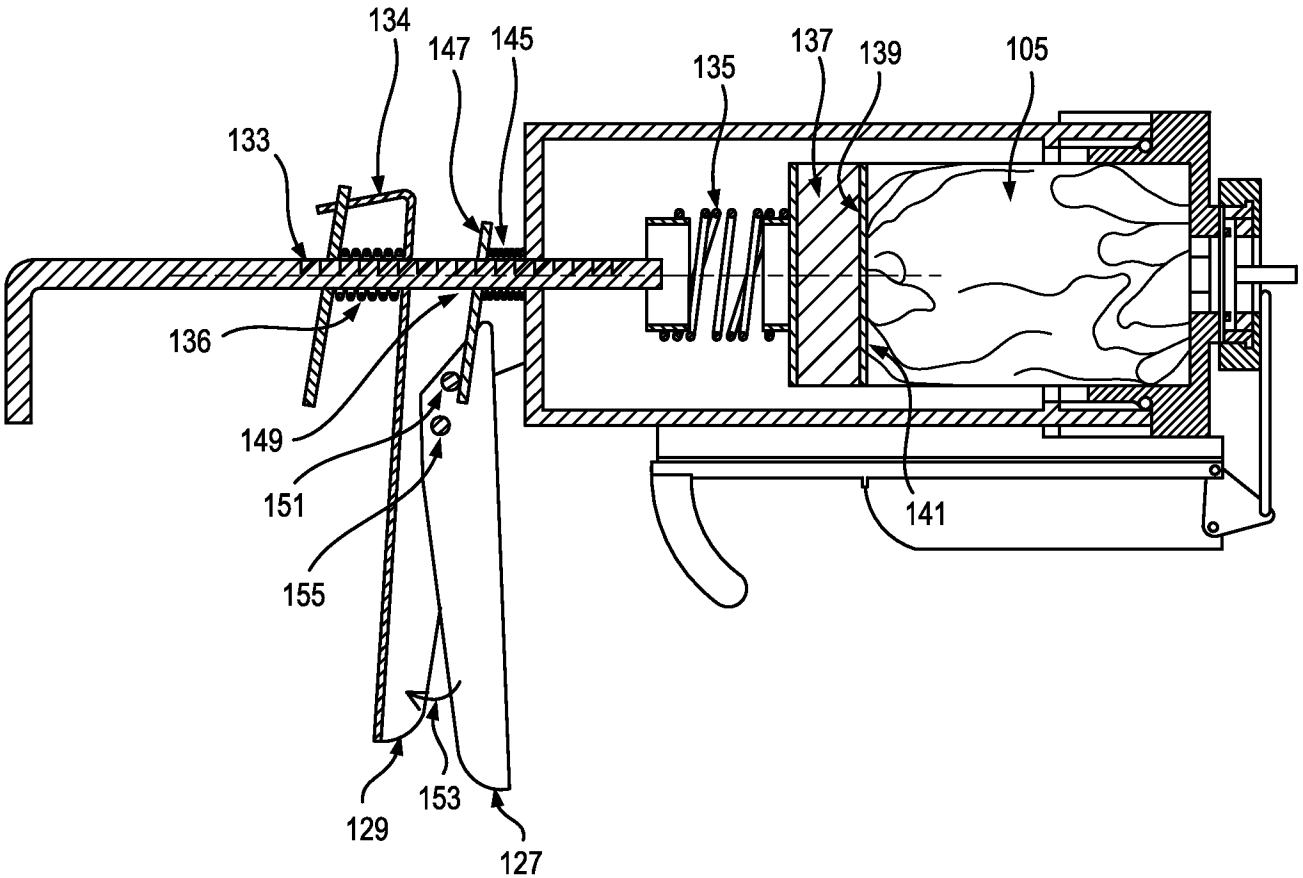
FIG. 7 is an exploded cross-sectional view of the plunger and associated components of the present invention wherein the plunger trigger is shown partially depressed in the second embodiment.

A description of the operation of the biased-spring 145 is as follows: handle 129 is depressed in the direction of arrow 153, pivoting about pivot pin 155 so that driving pin 151 moves the lower edge of jam plate 147 forward, toward housing 103. This causes the jam plate to cant so that it jams on one of the notches 133 along the length of plunger 131. Then, as plunger trigger 127 is moved further in the direction of arrow 153, jam plate 147 and plunger 131 move together towards housing 103. FIG. 7 shows plunger trigger 127 in the fully depressed state.

Figure 5:
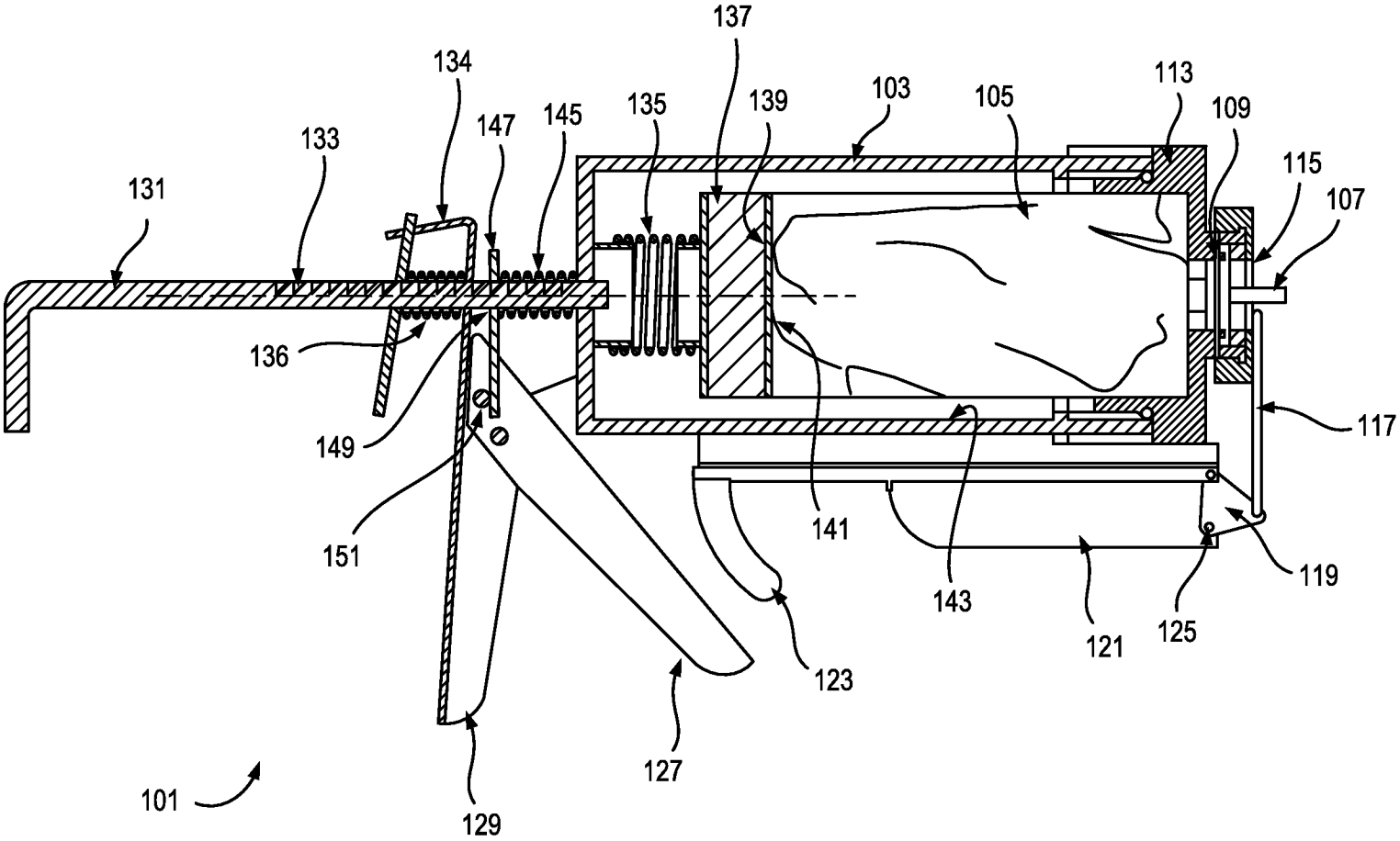
FIG. 5 is a cross-sectional view showing the internal components of the present invention in a second embodiment.
Figure 8:
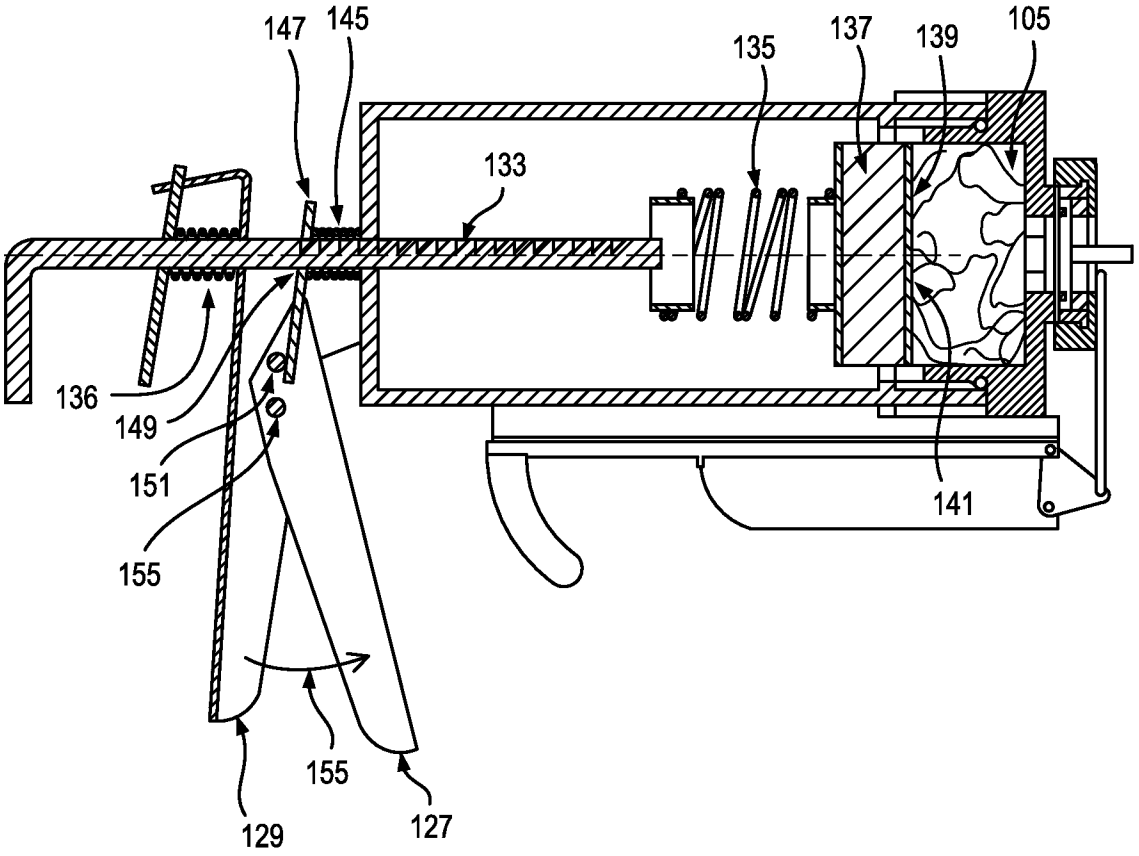
FIG. 8 is an exploded cross-sectional view of the plunger and associated components of the present invention wherein the plunger trigger has been released in the second embodiment.

When plunger trigger 127 is released it moves in the direction of arrow 155, as shown in FIG. 8. Jam plate 147 and plunger 131 move backward, together, away from housing 103. When plunger trigger 127 is fully released, jam plate 147 again rests against the inside surface of handle 129 and driving pin 151, having been moved back into position by biasing spring 145. With plunger trigger 127 fully released, as shown in FIG. 5 there is no resistance on plunger 131 and it slides freely through handle 129, jam plate 147, biasing spring 145, and housing 103.

The action of plunger 131 drives piston 137 against bottom surface 141 of container 105 crushing it from the bottom up as piston 137 moves along inside housing 103. As noted above, piston 137 is preferably a solid disk shape with a width large enough to prevent it from bending or otherwise causing it to become misshapen as it exerts force on container 105. Piston 137 may be made of metal, plastic or other materials that hold their shape. The operative features of piston 137 will now be described.

As described above, operation of plunger trigger 127 in the direction of arrow 153 moves plunger 131 while simultaneously allowing piston spring 135 to extend to push piston 137 against bottom surface 141 of container 105. As shown in FIG. 6 and FIG. 7, moving plunger 131 in the direction of container 105 causes piston 137 to contact and exert force on container 105 crushing it as piston 137 slides along the inside of housing 103. The crushing action on container 105 continues as piston spring 135 and piston 137 move in unison along the inside of housing 103. In addition to having a width permitting it to maintain its shape, piston 137 is also designed in a cylindrical shape to fit snugly within the cylindrical interior portion of housing 103. Interior surface 143 of housing 103 acts as a guide for piston 137 to keep it in place as it moves inside housing 103.

While forming housing 103 and piston 137 in a cylindrical shape has been proven to work, it is also possible that housing 103 and piston 137 could take on other shapes provided they are compatible. Interior surface 143 of housing 103 functions as a guide for piston 137 as the sidewalls of piston 137 contact interior surface 143 during operation of dispenser 101. It should also be noted that housing 103 works best when fully enclosed. One embodiment that is shown in the figures includes hinged panel 111 that is closed once container 105 is seated within housing 103. A hinge works well to ensure proper positioning of panel 111 and to prevent loss of panel 111 when it is open during loading of container 105. However, panel 111 could be removable without a hinge using tabs or other components to keep it in place. Or, slots could be cut in the side of housing 103 to allow the user to have a view of container 105 during operation so that a user can determine when container 105 is empty or nearly empty.

Figure 9:
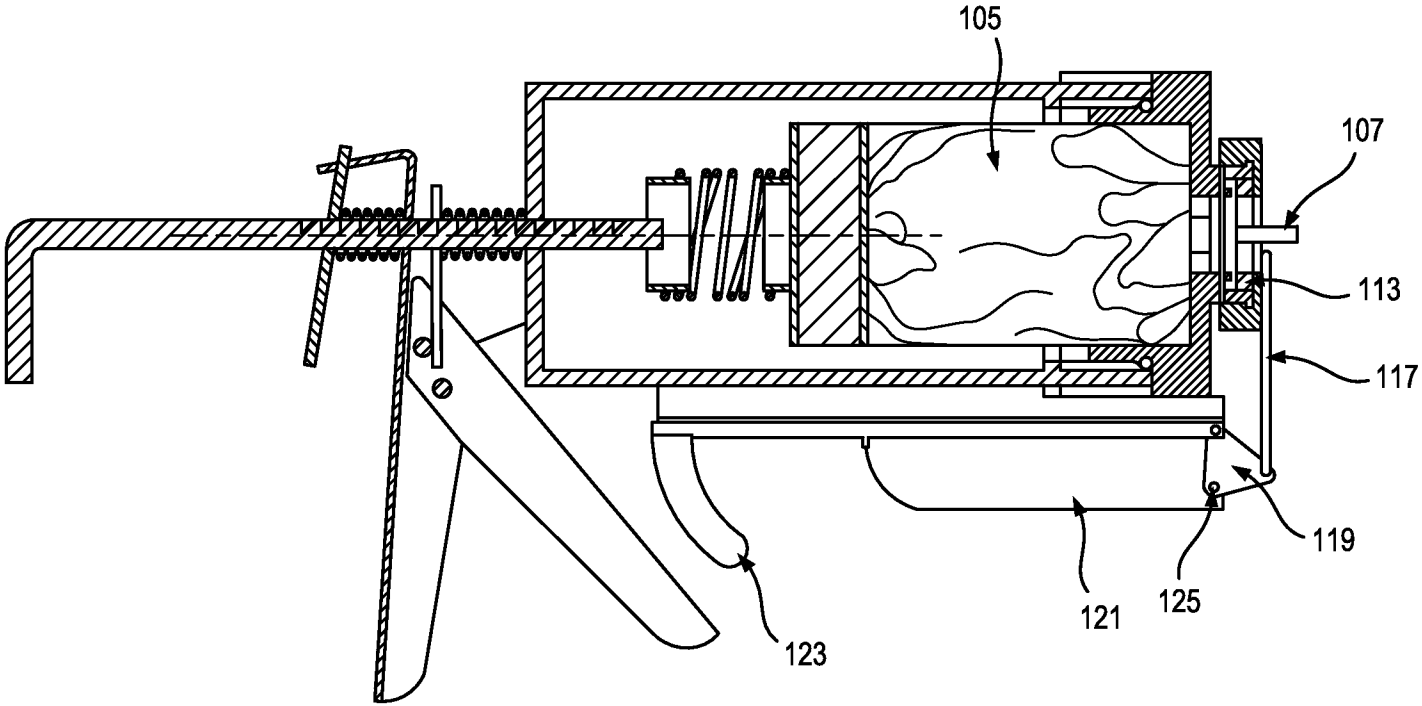
FIG. 9 is an exploded cross-sectional view of the spray trigger and associated components of the present invention where the spray trigger is in an initial state in the second embodiment.

Once plunger 131 is locked in place, jam plate 147 engages one of notches 133 along plunger 131 and container 105 is under pressure from piston 137 as it exerts force against bottom surface 141 of container 105. Container 105 is ready to release its contents through spray tip 107 as shown in FIG. 9.

Figure 10:
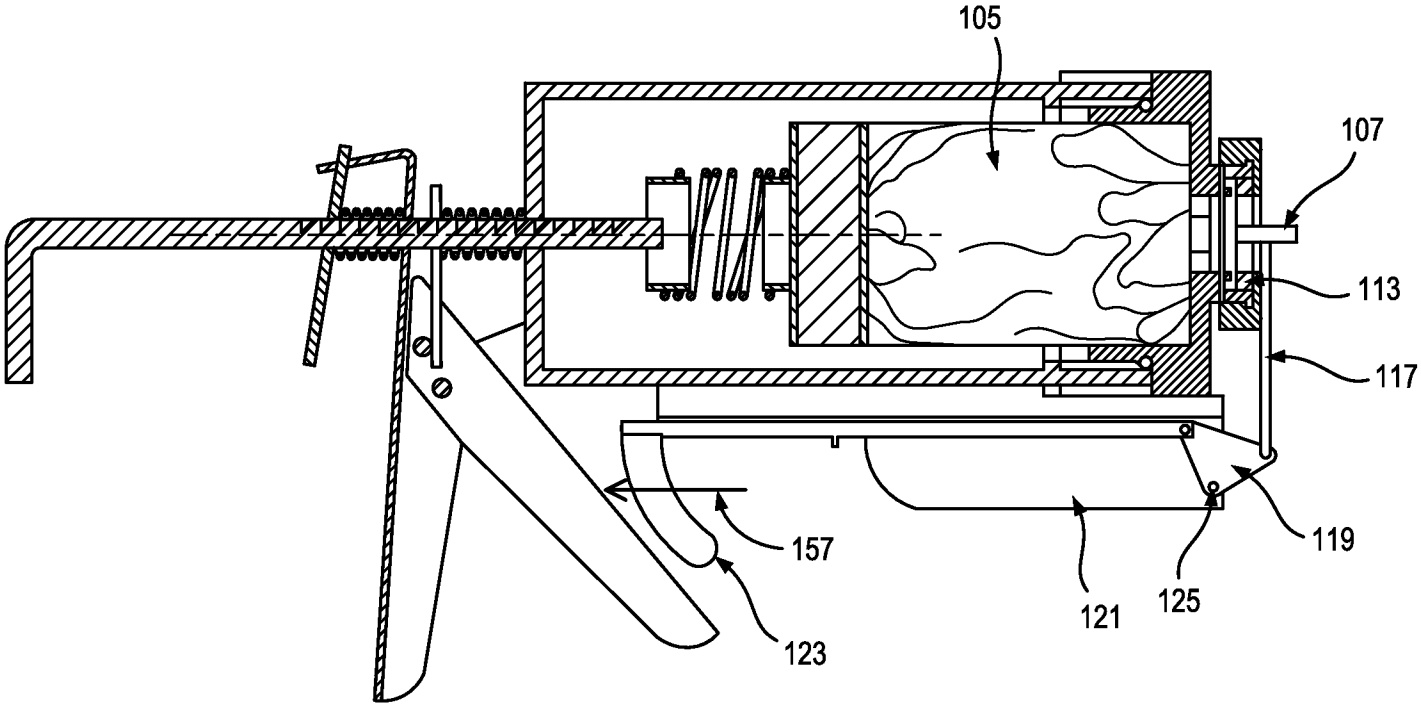
FIG. 10 is an exploded cross-sectional view of the spray trigger and associated components of the present invention where the spray trigger is has been released in the second embodiment.

To operate spray tip 107, a user pulls spray trigger 123 as shown in FIG. 10 in the direction of arrow 157. Trigger rod 117 contacts the forward surface of valve seat 113 and is attached to trigger plate 119. Trigger plate 119 is a substantially triangular flat component that provides a mounting point at each of its three corners. While trigger rod 117 is attached to one mounting point, the second mounting point is attached to trigger bracket 121. The third mounting point of trigger plate 119 is attached to spray trigger 123. Trigger pin 125 secures trigger rod 117 such that, when a user pulls spray trigger 123, trigger rod 117 pulls back spray tip 107, thereby allowing the pressurized contents of container 105 to spray through valve 109 and spray tip 107, and deliver the contents of container 105 as needed. There are many ways to design spray trigger 123 to cause spray tip 107 to open and release the contents of container 105 depending on the type of spray tip used. Two embodiments have been described herein, but many others would be apparent to one skilled in the art.

Figure 11:
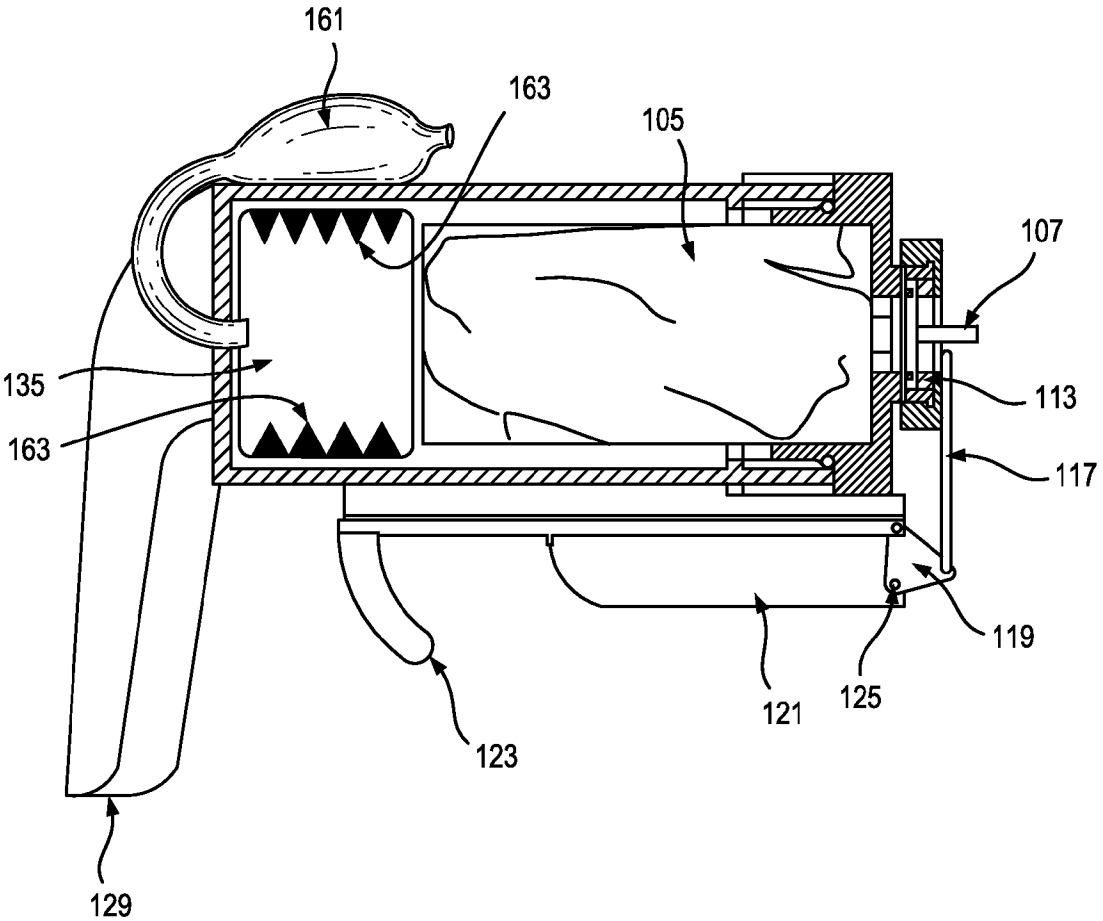
FIG. 11 is a side exterior view of a third embodiment of the dispenser system of the present invention using an air bladder.

FIG. 11 shows a pump 161 and air bladder 159 in combination to apply pressure to the piston and compress the container in place of the spring and plunger. By pumping up air bladder 159 with pump 161, air bladder 159 expands at expansion areas 163 to apply pressure directly to container 105 with the other components of the dispenser being as described above with respect to FIGS. 1-10. It is also possible to use a compressed air cartridge power source as an alternative to pump and air bladder 159 as a source of pressure against the piston.

Figure 12:
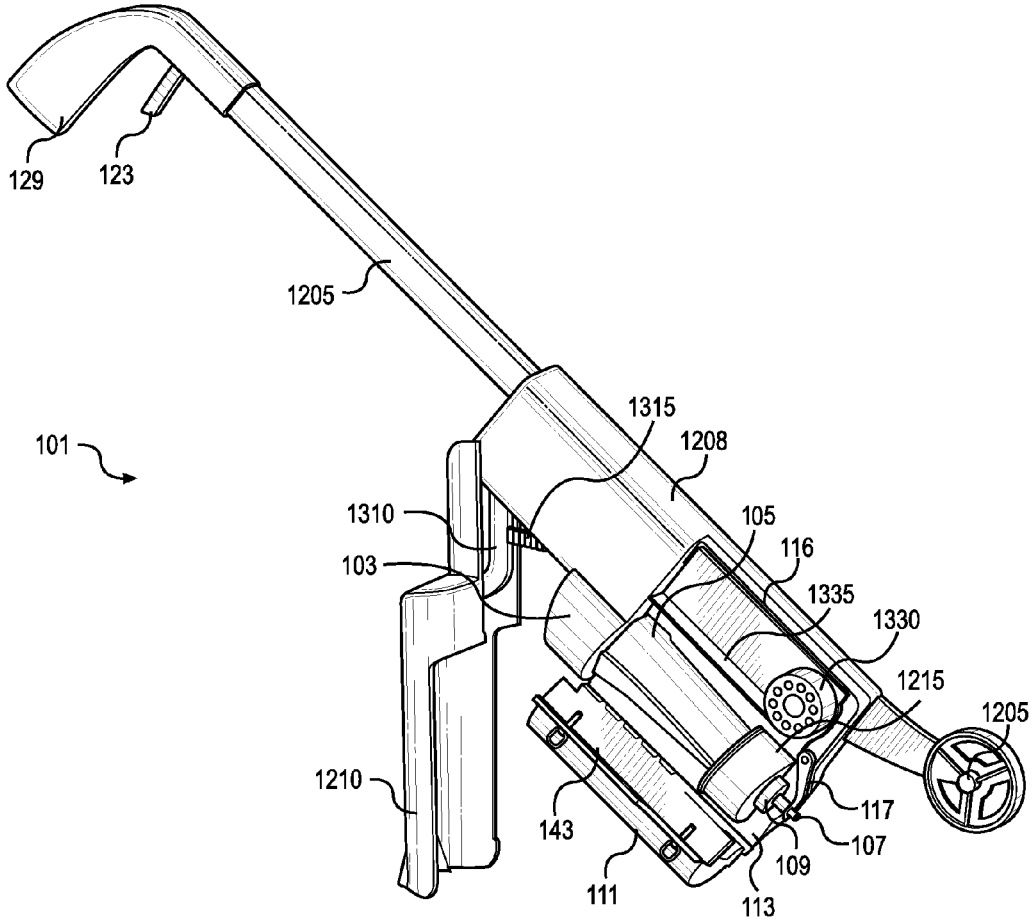
FIG. 12 is a perspective view of a fourth embodiment of the invention.

A fourth embodiment will now be described with respect to FIGS. 12-16. FIG. 12 shows a perspective view of a fourth embodiment of the invention. In the embodiment of FIG. 12, dispenser 101 includes an elongated mounting rod 1205, on which handle 129 and trigger 123 are positioned at one end, and housing 103 is positioned at the other end. Mounting rod 1205 extends the length of dispenser system 101 and permits a user to grasp handle 129 and operate trigger 123 at a distance from spray tip 107 so that spray tip may be near a spray target while the operator of system 101 is at a comfortable distance holding handle 129. For example, this configuration works well when system 101 is being used to spray a line down a length of road or on a grassy area to indicate the location of a gas line, water line, electrical line or other utility line. While mounting rod 1205 is useful in these types of applications, it is also possible to mount handle 129 and trigger 123 directly to housing 103 or an added upper portion 1208 of housing 103 within which other components of system 101 may be housed.

Figure 16:
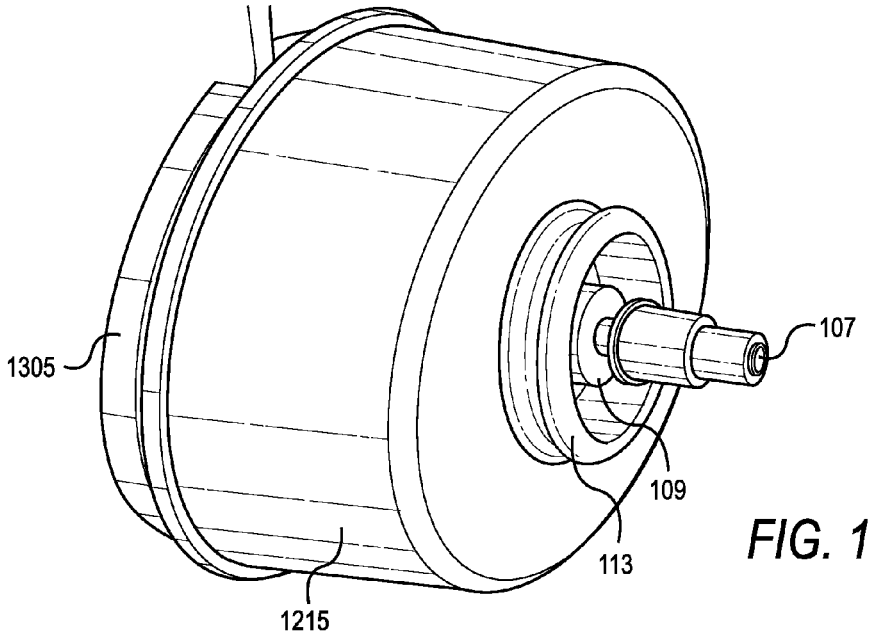
FIG. 16 is a perspective view of a fourth embodiment showing a cap, valve and spray tip.

According to the design of the fourth embodiment, flexible container 105, spray tip 107, valve 109 and valve seat 113 are all configured similarly to the other embodiments described above. A cylindrical shaped end cap 1215 shown in detail in FIG. 16 is positioned over the end of flexible container 105 to ease the seating of valve 109 in valve seat 113. It should be understood that end cap 1215 is an optional component and is not necessary for effective operation of the invention. If end cap 1215 is used, spray tip 107 and valve 109 are inserted through an opening in end cap 1215 and spray tip 107 and valve 109 further pass through to the outside of housing 103. End cap 1215 may be made of plastic, aluminum or other molded, lightweight, inexpensive material. During the process of sliding within housing 103 and crushing bag 105, as piston 1305 reaches the top of bag 105, it engages snugly against the open end of end cap 1215 to ensure that the contents of the bag are fully exited from bag 105.

Hinged panel 111 attached to housing 103 rotates between an open position in which flexible container 105 may be inserted into housing 103, and a closed position in which panel 111 forms a portion of housing 103 to securely maintain flexible container 105 within housing 103.

A guide wheel 1205 is shown attached to upper portion 1208 of housing 103. Guide wheel 1205 may be used to maintain the spray tip at a particular distance from the spray target as it is rolled along the ground or a wall. Guide wheel 1205 is an optional feature of dispenser 101.

Figure 13:
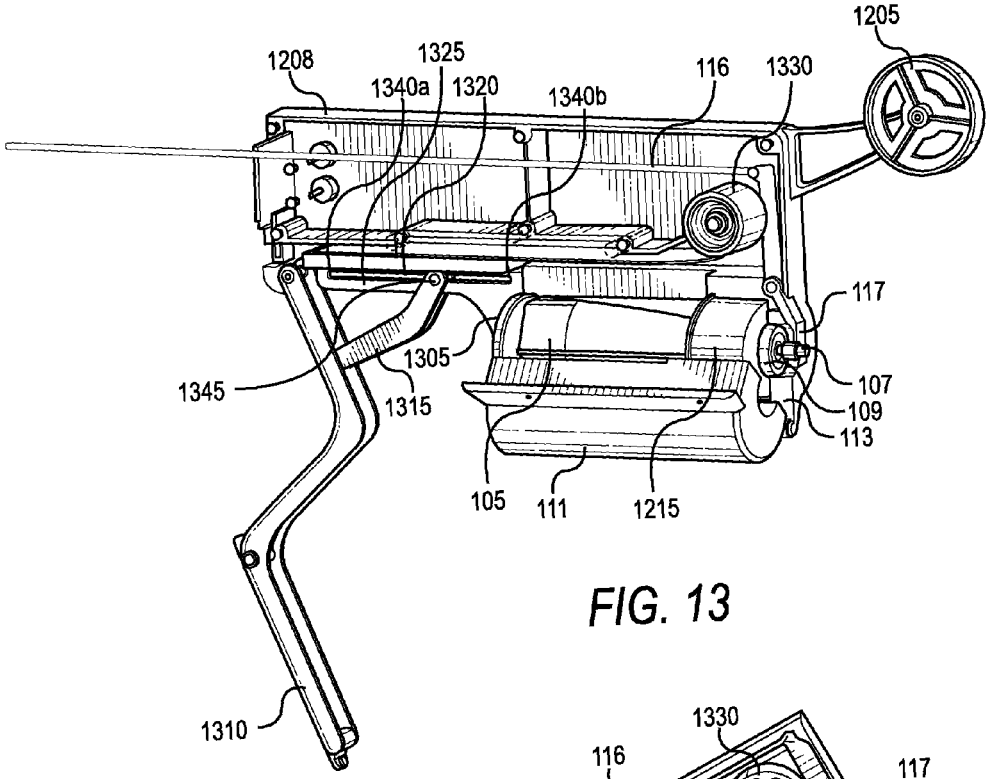
FIG. 13 is a cut-away side perspective view of the fourth embodiment of the invention.
Figure 14:
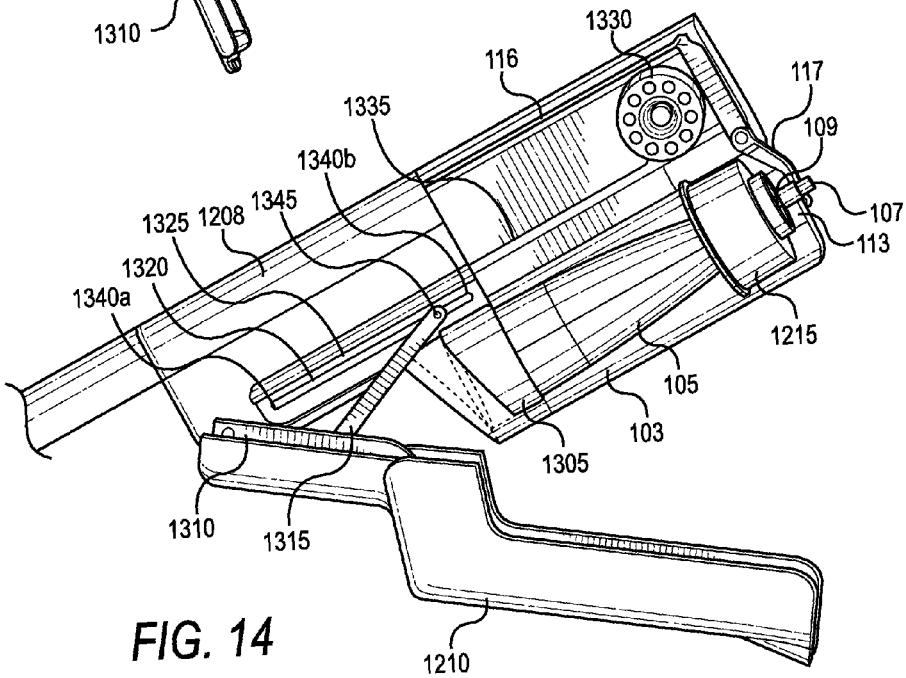
FIG. 14 is a cut-away side perspective view of a fourth embodiment showing a piston and associated components.
Figure 15:
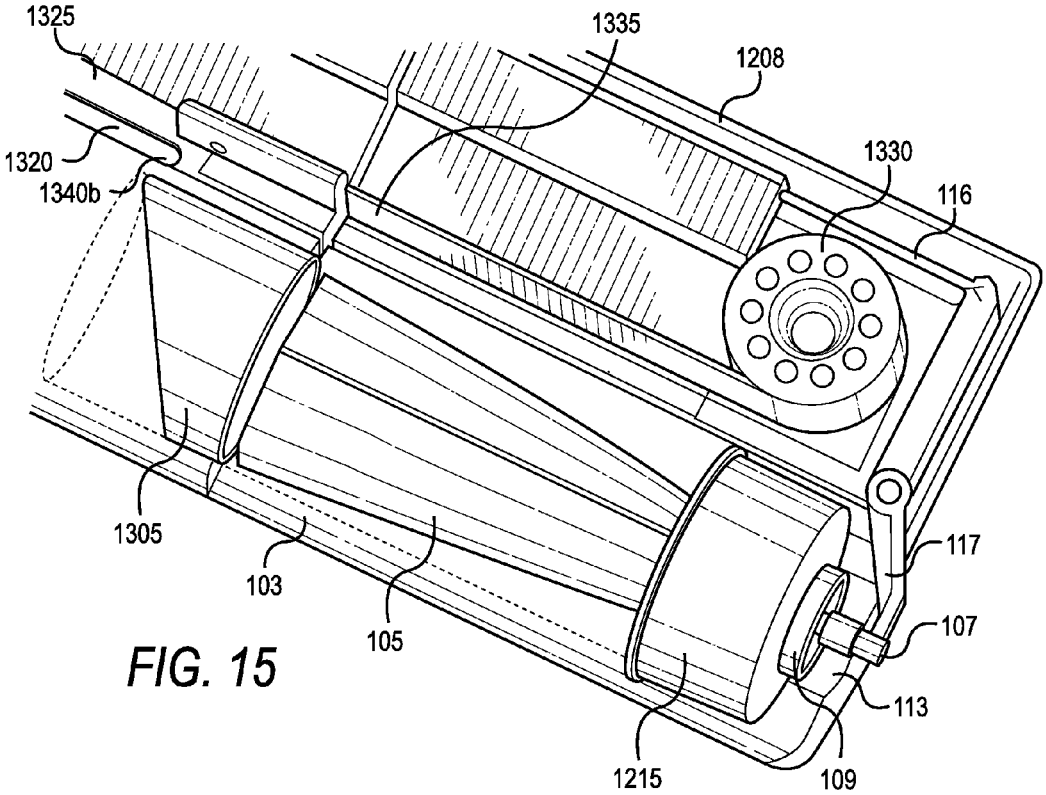
FIG. 15 is a side exterior view of a fourth embodiment showing a crushable container with a valve and spray tip.

A movable piston 1305 is shown in the cutaway view of dispenser 101 in FIG. 13 where the interior of housing 103 can be seen. Piston 1305 is biased against flexible container 105 and operates in a manner similar to piston 137 as described with respect to the embodiment of FIG. 1. Instead of using a trigger 127 to apply pressure to piston 137 against flexible container 105 as in the above described embodiments, in the embodiment of FIGS. 12-16, a coil spring 1330 is used. Coil spring 1330 is positioned inside housing 103 with an uncoiled end portion 1335 attached to piston 1305. Coil springs of the type such as coil spring 1330 as shown are well known and are biased to draw uncoiled end portion 1335 back towards coil 1330. In so doing, coil spring 1330 applies continuous pressure to piston 1305 to maintain piston 1305 in contact with the bottom of bag 105 pulling piston 1305 against bag 105 as bag 105 is crushed. The dimensions and tension of coil spring 1330 are design choices for the designer and depend on the size of bag 105, housing 103 and the positioning of coil spring 1330 in housing 103 relative to piston 1305.

A hinged lever 1310 (see FIG. 13) attached to a shell 1210 that matches the shape of the bottom of housing 103 is used to release piston 1305 so that a new bag may be inserted in dispenser 101 when the current bag has been emptied. When shell 1210 pivots between an open and a closed position, hinged lever 1310 mounted to the inside surface of shell 1210 moves an arm 1315, a first end of which is attached to hinged lever 1310 and a second end of which fits in a slot 1320 in a rib 1325 extending from the backside of piston 1305. When hinged lever 1310 is pivoted open or closed, a pin 1345 at the second end of arm 1315 moves through slot 1320 (see FIG. 14) between the two ends 1340*a* and 1340*b* of slot 1320. While a new container is inserted into housing 103, lever 1310 is open and arm 1315 is at end 1340*a*. When lever 1310 is closed, arm 1315 slides to end 1340*b* in slot 1320 and coil spring 1330 engages piston 1305 causing it to be pulled against flexible container 105. Pressure from coil spring 1330 is applied to the bottom of container 105, which in turn maintains pressure on the contents of container 105.

While the invention has been described with respect to the figures, it will be appreciated that many modifications and changes may be made by those skilled in the art without departing from the spirit of the invention. Any variation and derivation from the above description and drawings are included in the scope of the present invention as defined by the claims. For example, in the alternative, dispenser 101 may be implemented using an electric or battery powered plunger and piston arrangement that may be adapted for use from the description of U.S. Pat. No. 6,123,235 to Hsu which is incorporated by reference herein. A battery powered plunger and piston of the type described by Hsu would eliminate the need to manually ratchet the plunger and piston configuration of the present invention. In addition, instead of using a coil spring to apply pressure to the piston as shown in the fourth embodiment of FIGS. 12-16, a spring-loaded rotating spool onto which a cloth or nylon band or cord is spooled could be used to apply tension to the piston.

What is claimed is:

1. A system for dispensing sprayable material comprising:

a flexible container having a body, a bottom and a top forming an exterior surface and an interior space within which a material is housed and further comprising a spray tip mounted on a valve through which the sprayable material is sprayed;

a dispenser configured to exert pressure on the flexible container to force the sprayable material through the tip, the dispenser comprising:

an elongated housing formed with an interior portion;

a movable panel on the elongated housing wherein in an open position the interior portion is exposed through which the flexible container is placed in the interior portion, and in a closed position an interior surface of the housing and an interior surface of the movable panel form a rigid enclosure contacting the exterior surface of the flexible container and counteracting pressure exerted on the flexible container;

a fixed plate forming a first end of the housing with a valve seat in which the valve is seated;

a piston positioned inside the housing with a first side in slidable contact with the bottom of the container;

a rib connected to a second side of the piston and having an elongated slot;

a lever affixed to the housing that moves between an open position and a closed position;

an arm having a first end attached to the lever and a second end slidably mounted in the elongated slot;

a handle attached to the housing;

a trigger mounted proximate the handle that moves between a first position and a second position, wherein in the first position, the trigger causes the opening of the valve releasing the sprayable material from the container and in the second position, the valve is closed; and a biasing element in movable connection with the piston for biasing the piston against the bottom of the container.

2. The system of claim 1 wherein the movable panel is a door that is hingably affixed to the housing.

3. The system of claim 1 wherein the flexible container is composed of a crushable material that is substantially completely expelled from the container as the flexible container is crushed without blocking an opening of the valve.

4. The system of claim 1 further comprising a guide wheel that is affixed to the housing and which rotates as the system is moved linearly maintaining the spray tip at a fixed distance from a spray target.

5. The system of claim 1 further comprising an end cap having a hole through which the spray tip and valve are positioned.

6. The system of claim 1 wherein the housing further comprises a mounting rod wherein the handle is mounted to a first end of the mounting rod and a second end of the mounting rod is affixed to an upper portion of the housing.

7. The system of claim 1 wherein the biasing element is a coil spring.

8. A system for dispensing the contents of a flexible container comprising:

an elongated housing formed with an interior portion;

a movable panel on the elongated housing wherein in an open position the interior portion is exposed through which the flexible container is placed in the interior portion, and in a closed position an interior surface of the housing and an interior surface of the movable panel form a rigid enclosure contacting the exterior surface of the flexible container and counteracting pressure exerted on the flexible container;

a first end of the housing adapted to receive a valve of the container;

a piston positioned inside the housing with a first side in slideable contact with the bottom of the container;

a rib connected to a second side of the piston and having an elongated slot;

a lever affixed to the housing that moves between an open position and a closed position;

an arm having a first end attached to the lever and a second end slidably mounted in the elongated slot;

a biasing element in movable connection with the piston for biasing the piston against the bottom of the container;

a handle attached to the housing;

a trigger mounted proximate the handle that moves between a first position and a second position, wherein in the first position, the trigger causes the opening of the valve releasing the sprayable material from the container and in the second position, the valve is closed.

9. The system of claim 8 wherein the movable panel is a door that is hingably affixed to the housing.

10. The system of claim 8 wherein the flexible container is composed of a crushable material permitting the material to be substantially completely vacated from the container without blocking an opening in the valve.

11. The system of claim 8 further comprising a guide wheel that is affixed to the housing and which rotates as the system is moved linearly maintaining the spray tip at a fixed distance from a spray target.

12. The system of claim 8 further comprising an end cap having a hole through which the spray tip and valve are positioned.

13. The system of claim 8 wherein the housing further comprises a mounting rod wherein the handle is mounted to a first end of the mounting rod and a second end of the mounting rod is affixed to an upper portion of the housing.

14. The system of claim 8 wherein the biasing element is a coil spring.

15. A method for dispensing the contents of a flexible container from a dispenser with an elongated housing into which the flexible container is placed, wherein the flexible container has a body, a bottom and a top forming an exterior surface and an interior space within which the contents are housed and a tip mounted on a valve through which the contents are dispensed, the method comprising:

receiving the flexible container through a movable panel in the elongated housing in an interior portion of the dispenser wherein in an open position of the movable panel, the interior portion is exposed through which the flexible container is placed in the interior portion, and in a closed position of the movable panel, an interior surface of the housing and an interior surface of the movable panel form a rigid enclosure contacting the exterior surface of the flexible container and counteracting pressure exerted on the flexible container;

seating the valve at a first end of the housing;

contacting the bottom of the container with a first side of a piston positioned inside the housing;

configuring a lever in slidable connection with a second side of the piston inside and along the length of the housing;

biasing the piston against the bottom of the container;

activating the lever causing the plunger to slide within the housing exerting force on the bottom of the container; and pulling a trigger affixed proximate a handle on the housing placing the valve in an open position and releasing material from the container.

16. The method of claim 15 wherein the movable panel is a door that is hingably affixed to the housing.

17. The method of claim 15 wherein the flexible container is composed of a crushable material that is substantially completely vacated from the container as the flexible container is crushed without blocking an opening of the valve.

18. A method for dispensing the contents of a flexible container from a dispenser with an elongated housing into which the flexible container is placed, wherein the flexible container has a body, a bottom and a top forming an exterior surface and an interior space within which the contents are housed and a tip mounted on a valve through which the contents are dispensed, the method comprising:

receiving the flexible container through a movable panel in the elongated housing in an interior portion of the dispenser wherein in an open position of the movable panel, the interior portion is exposed through which the flexible container is placed in the interior portion, and in a closed position of the movable panel, an interior surface of the housing and an interior surface of the movable panel form a rigid enclosure contacting the exterior surface of the flexible container and counteracting pressure exerted on the flexible container;

seating the valve at a first end of the housing;

slidably contacting the bottom of the container with a first side of the piston positioned inside the housing;

configuring a lever in slidable connection with a second side of the piston inside and along the length of the housing;

biasing the piston against the bottom of the container;

activating the lever causing the plunger to slide within the housing exerting force on the bottom of the container; and pulling a trigger affixed proximate a handle on the housing placing the valve in an open position and releasing material from the container.

19. The method of claim 18 further comprising maintaining the top of the flexible container in place inside the rigid enclosure as the flexible container is crushed from the bottom by the piston.

20. The method of claim 18 wherein the interior surface of the housing and the interior surface of the panel that form the rigid enclosure contact the exterior surface of the container as pressure is exerted on the container by the plunger preventing the container from bursting.

21. The method of claim 18 wherein the movable panel is a door that is hingably affixed to the housing.

22. The method of claim 18 wherein the flexible container is composed of a crushable material that is substantially completely vacated from the container as the flexible container is crushed without blocking an opening of the valve.

* * * * *